US005080141A

United States Patent [19]

Bottger et al.

[11] Patent Number: 5,080,141

[45] Date of Patent: Jan. 14, 1992

[54] MULTIPLY FABRIC HAVING CENTER PORTION WITH DELICATE WARP THREADS AND LATERAL PORTIONS WITH ROBUST THREADS

[75] Inventors: Wolfgang Bottger, Ködnitz; Kurt Biedermann, Kulmbach, both of Fed. Rep. of Germany

[73] Assignee: Vorwerk & Co. Interholding GmbH, Fed. Rep. of Germany

[21] Appl. No.: 481,785

[22] Filed: Feb. 16, 1990

Related U.S. Application Data

[62] Division of Ser. No. 132,954, Nov. 4, 1987, Pat. No. 4,903,737.

[30] Foreign Application Priority Data

Mar. 12, 1986 [DE] Fed. Rep. of Germany ..... 3608136

[51] Int. Cl.[5] ..... D03D 15/00

[52] U.S. Cl. ..... 139/383 R; 139/420 R; 139/420 C; 139/408; 428/225

[58] Field of Search ..... 139/383 R, 408, 413, 139/416, 420 R, 420 C, 420 A, 457, 458, 384 R; 428/225, 241, 244, 232

[56] References Cited

U.S. PATENT DOCUMENTS

| | | | |
|---|---|---|---|
| 2,210,290 | 8/1940 | Heinsohn | 139/420 R |
| 2,741,824 | 4/1956 | Robbins et al. | 139/384 R X |
| 2,754,855 | 7/1956 | Foley | 139/384 R |
| 3,669,158 | 6/1972 | Phillips | 139/420 R |

FOREIGN PATENT DOCUMENTS

| | | | |
|---|---|---|---|
| 1238895 | 7/1960 | France | 139/383 R |

*Primary Examiner*—Andrew M. Falik
*Attorney, Agent, or Firm*—Watson, Cole, Grindle & Watson

[57] ABSTRACT

A multiply fabric which has a center portion and lateral marginal portions, the warp threads in the center portion being carbon fibers or glass fibers and the warp threads in the lateral marginal portions being made of a robust material having a high tensile strength, the fabric including at least 20 weft threads per cm of warp threads and a plurality of weft threads in a single shed in the center portion.

4 Claims, 2 Drawing Sheets

MULTIPLY FABRIC HAVING CENTER PORTION WITH DELICATE WARP THREADS AND LATERAL PORTIONS WITH ROBUST THREADS

This application is a divisional application of application Ser. No. 132,954, filed Nov. 4, 1987, U.S. Pat. No. 4,903,737.

BACKGROUND OF THE INVENTION

1. Field of the Invention

This invention relates to a multi-ply fabric which is made of extremely delicate technical grade fibers such as carbon fibers, glass fibers and the like.

2. The Prior Art

British Patent No. 2,066,308 describes three-dimensional fabrics using carbon fibers or glass fibers. There has also been proposed a method for weaving carbon fibers wherein impacts are avoided so as to take into account their extreme brittleness, which is caused by their temperature coefficient of near zero.

Furthermore, European Patent 00 56 351 describes a sheet-like fabric consisting of high-strength material, such as metal fibers, carbon fibers, aramide fibers or mixtures thereof. This sheet fabric is made into a particular shape.

In known systems the result produced has been unsatisfactory because after each filler thread has been inserted into the shed in a conventional loom it has been beaten. In this regard, the dents of the reed rub along the warp threads both during forward and backward motion thereof. In the case of high or very high filler thread counts, there is a proportionality between the respective stroke of the reed, the warp, the filler thread count and the stroke of the sley.

In order to reduce rubbing damage to the delicate warp material, it has been proposed to weave post-twisted warp material or warp material with fibers wrapped around the warp material. However, this results in a reduction in relative strength to the entire fabric which in many cases is not acceptable.

The object of the present invention is to avoid the above-mentioned disadvantages and to devise a method and an apparatus for creating a fabric whose delicate warp threads have not been impaired during manufacture even when there is a high filler thread count.

SUMMARY OF THE INVENTION

The system in accordance with the invention offers the advantage that delicate yarns of the type mentioned may be woven into fabrics with appropriate weaves so as to have filler thread counts of 20 to over 150 per cm and so that the production of technical grade fabrics with a three-dimensional structure (multi-ply fabrics) and a very dense arrangement of the filler and warp threads becomes possible. Even in the case of a correspondingly high number of filler threads, the friction of the reed dents on the warp threads may be so substantially reduced that damage to the fabric is avoided. This is especially important with delicate materials used for the warp ends so that—as has proved to be the case—it is especially here that a reduction in strength due to damage to the individual fibers of the thread is avoided. It is more especially in the case of multi-ply fabrics that this leads to an optimum product. If such a fabric is woven with marginal zones whose warp threads are less delicate and whose filler threads are beaten up after each insertion action, the result will be an intermediate product which is quite satisfactory as regards freedom from damage in which the marginal zones may be cut off and with minimum loss and the center multi-ply part may be further used.

The invention is shown in the drawings and will be described.

DESCRIPTION OF THE PREFERRED EMBODIMENT

Figure 1:
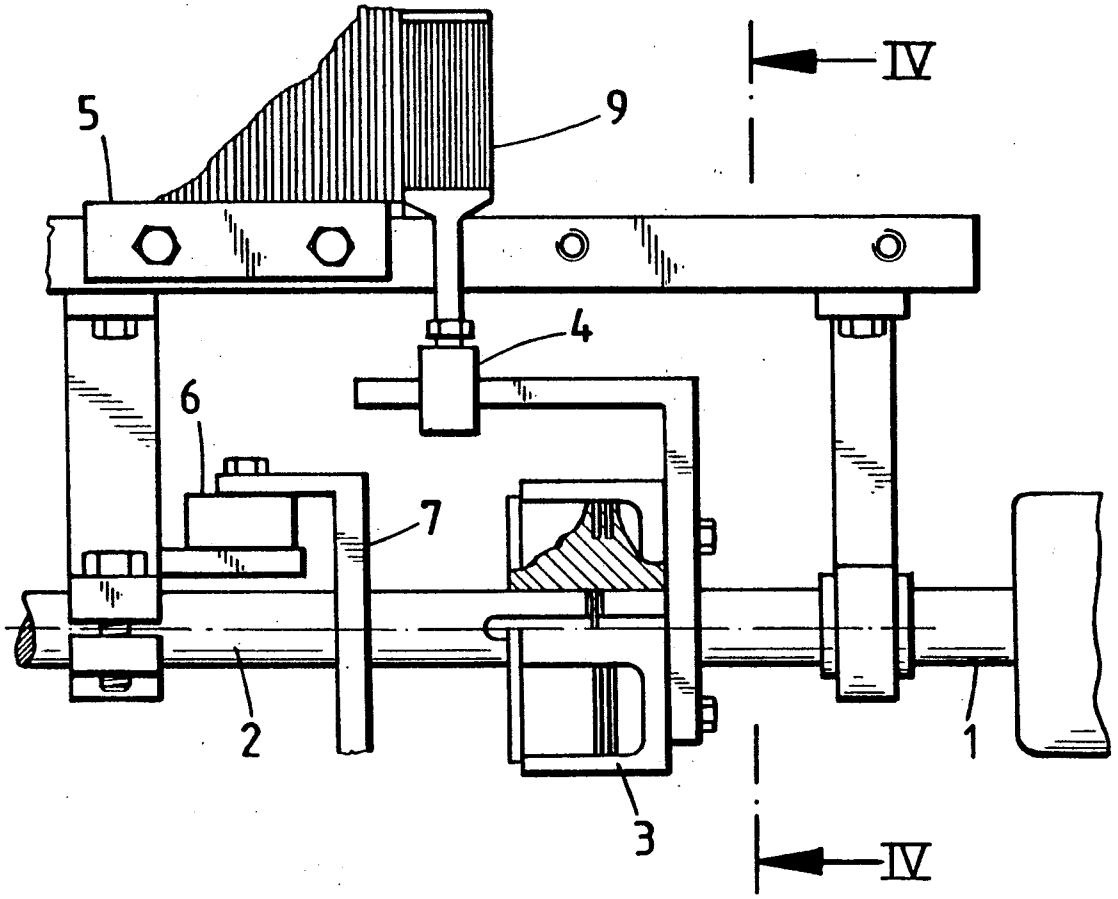
FIG. 1 shows an end view of a portion of a loom used to make a multi-ply fabric according the present invention.

The permanent connections in the form of shaft couplings between the transmission shaft 1 and the reed driving shaft 2—see FIG. 1—have been replaced by clutches 3—see FIG. 1. The operation of the clutches here is by means of conventional methods: a perforated dobby card or another commercially conventional color select device. In this respect the meanings are as follows:

Hole=actuation of the clutch=beat of the reed after filler thread insertion.

Hole absent=non-actuation of the clutch=no beat up, or vice versa.

Since in any case the drive shafts produce the intermittent motion for the reed beat up independently of this operating action, the two outer sley supports are provided with bushes so that they are no longer used for driving the reed but only for support of the reed.

The reed segment holders 4—see FIG. 1—are screwed on the clutch parts adjacent to the right hand and left hand drive, which take part in the constantly occurring intermittent motion of the drive shafts. These segment holders receive the reed segments 9—see FIG. 1—for a breadth corresponding to the breadth of the fabric selvedge.

The reed segments, which function directly to the left and right of the reed, perform the beat up of the weft thread at the right and left hand fabric edge after each weft thread insertion. The warp threads of the fabric selvedge are of a robust material.

This arrangement serves to ensure that each weft thread is deposited about 1 to 3 cm short of the edge of the material if there is no regular beat up by the reed.

Figure 3:
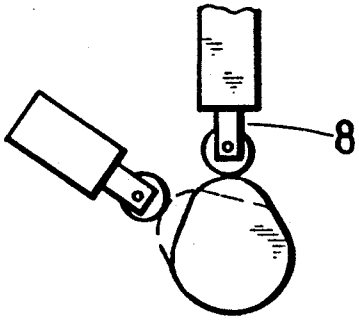
FIG. 3 shows a part of the loom adjacent to the limit control switch thereof.

In accordance with the weave design selected is thus possible for a plurality of weft threads to be inserted which are jointly beaten up as a group of weft threads after actuation of the clutches, with one stroke of the reed against the edge of the fabric. By suitable operation of the position switch of the color selector (not illustrated here) by way of the limit switch 8—see FIG. 3—it is possible to ensure that the actuation and declutching of the gear tooth couplings is only possible when the reed is stationary in the rearmost position.

Figure 2:
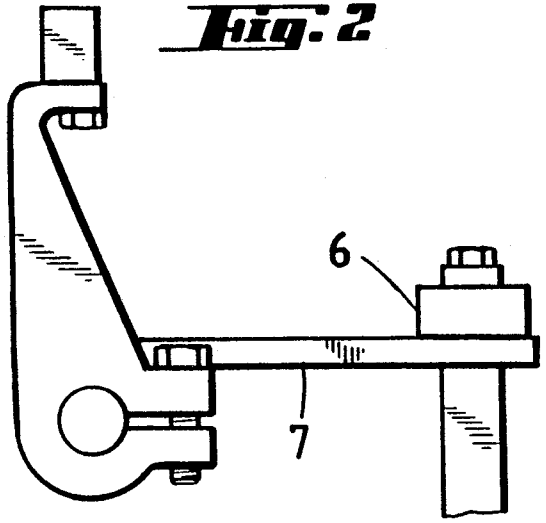
FIG. 2 shows a side view of a part of a loom of FIG. 1, showing the means for positioning and arresting the motion of the main reed holder.

The precise positioning and the locking of the reed holder with the gear tooth clutch in the declutched setting is achieved by the electric retaining magnet 6 with the setting plate 7—see FIGS. 1 and 2. In this case the electric circuit is so designed that the retainer magnet and the gear tooth clutch operate in synchronism.

The principle of the periodic beat up by the reed is to be made to match the selected weave. In particular, this principle is suitable for the production of multi-ply fabrics which are so designed that periodically several shedding motions take place only downwards or upwards.

The object of providing the most gentle treatment possible for the warp material during weaving is more effectively achieved if the number of beat ups of the reeds is as small as possible in relation to the number of weft threads inserted.

The number of the weft threads to be beaten up simultaneously onto the edge of the fabric as a group of threads depends on the weave and may be at least 2 and up to more than 10 filler threads as a maximum.

Without a beat up it is in each case possible to insert as many weft threads as there are shedding operations without any cross over of the warp threads.

This occurs:

(1) more especially in the case of multi-ply fabrics, in which the weft threads are inserted in a plurality of planes, the shedding motion only taking place downwards or upwards, and (2) on the insertion of two or more weft threads in an uninterrupted succession into the same shed.

Figure 4:
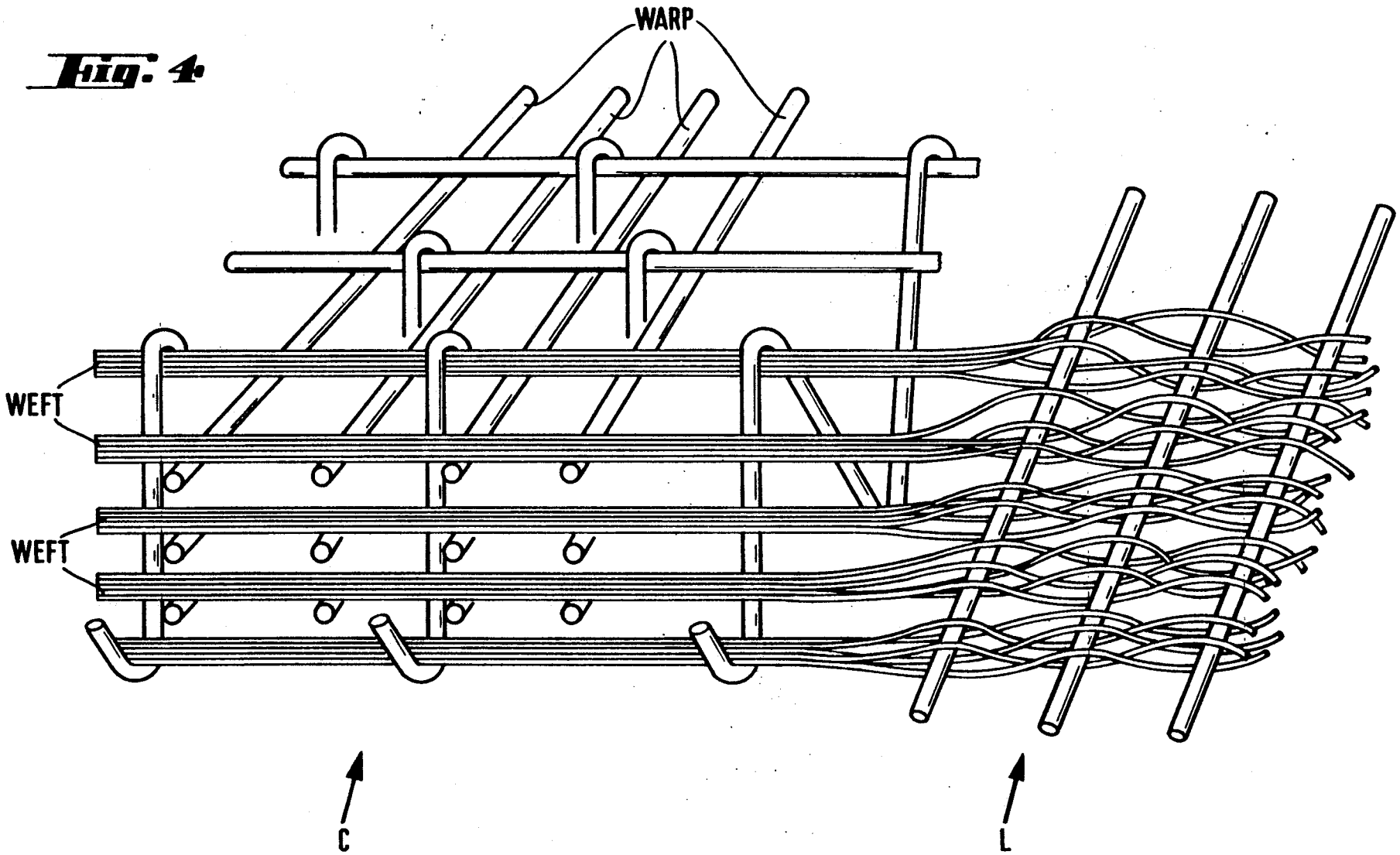
FIG. 4 shows a portion of a multi-ply fabric according to the present invention.

FIG. 4 shows a portion of a multi-ply fabric according to the invention, the warp and weft threads producing a three-dimensionally woven center part C and a two-dimensionally woven lateral portion L (a similar lateral portion is provided on the other side of the center part C).

It has been discovered that the features of the finished fabric, which it possesses owing to the fact that lateral marginal zones are beaten up after each shuttle motion whereas the middle part is only beaten up after a filler thread group of a certain size, more particularly in the case of technical grades of fabric, do not interfere with their use. For adaptation to certain applications or for optimizing the ratio of volume to strength it is possible after weaving for the marginal zones having normal but less delicate warp threads to be cut off for the full breadth or for only part of the breadth.

We claim:

1. A fabric which has a center portion and respective lateral marginal portions along opposite sides of said center portion, said center portion including warp threads made of a delicate material and said lateral marginal portions including warp threads made of a robust material, said fabric including weft threads in an amount of at least 20 weft threads per cm of warp threads, a multiplicity of said weft threads in said center portion being in a single shed.

2. A fabric according to claim 1, wherein said warp threads in said center portion are made of carbon fibers.

3. A fabric according to claim 1, wherein said warp threads in said center portion are made of glass fibers.

4. A fabric according to claim 1, wherein said center part is three-dimensionally woven and said lateral marginal parts are two-dimensionally woven.

* * * * *